US009601082B2

(12) United States Patent
Guo et al.

(10) Patent No.: US 9,601,082 B2
(45) Date of Patent: Mar. 21, 2017

(54) DISPLAY SUBSTRATE AND DRIVING METHOD THEREOF AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 136 days.

(21) Appl. No.: 14/498,143

(22) Filed: Sep. 26, 2014

(65) Prior Publication Data

US 2015/0235617 A1 Aug. 20, 2015

(30) Foreign Application Priority Data

Feb. 20, 2014 (CN) ..... 2014 1 0057477

(51) Int. Cl.

| | |
|---|---|
| ***G09G 5/04*** | (2006.01) |
| ***G09G 3/20*** | (2006.01) |
| ***G09G 5/02*** | (2006.01) |

(52) U.S. Cl.

CPC ..... *G09G 5/04* (2013.01); *G09G 3/2003* (2013.01); *G09G 5/02* (2013.01);

(Continued)

(58) Field of Classification Search

CPC ... G09G 2300/0452; G09G 2320/0686; G09G 2340/0457; G09G 5/04; G09G 3/2003; G09G 5/02

(Continued)

(56) References Cited

U.S. PATENT DOCUMENTS 4,652,912 A * 3/1987 Masubuchi ..... H04N 9/12 345/589
5,113,274 A * 5/1992 Takahashi ..... G09G 3/3607 349/109

(Continued)

FOREIGN PATENT DOCUMENTS

CN 1510656 A 7/2004
CN 1692389 A 11/2005

(Continued)

OTHER PUBLICATIONS

Notification of the First Office Action dated Aug. 5, 2015 corresponding to Chinese application No. 201410057477.3.

(Continued)

*Primary Examiner* — Lun-Yi Lao
*Assistant Examiner* — Kelly B Hegarty
(74) *Attorney, Agent, or Firm* — Nath, Goldberg & Meyer; Joshua B. Goldberg; Christopher Thomas

(57) ABSTRACT

The invention discloses a display substrate and a driving method thereof, and a display device. The display substrate includes a plurality of rows or columns of pixel units, wherein each row or column of pixel units include first pixel units and second pixel units which are arranged alternately, one first pixel unit and one second pixel unit are composed of three sub-pixels, and wherein the first pixel unit includes a first sub-pixel and a second sub-pixel, the second pixel unit includes the second sub-pixel and a third sub-pixel, and the first, second and third sub-pixels are arranged in turn. In the (Continued)

invention, three sub-pixels form two pixel units, thus the number of the sub-pixels needed to form a certain number of pixel units is decreased, and the manufacturing process is simplified and the defective rate of product is decreased.

9 Claims, 8 Drawing Sheets

(52) U.S. Cl.
CPC ..... *G09G 2300/0452* (2013.01); *G09G 2320/0686* (2013.01); *G09G 2340/0457* (2013.01)

(58) Field of Classification Search
USPC ..... 345/690, 694
See application file for complete search history.

(56) References Cited

U.S. PATENT DOCUMENTS

| | | | | |
|---|---|---|---|---|
| 6,563,502 | B1 * | 5/2003 | Dowling | G06K 15/02 345/467 |
| 6,661,429 | B1 * | 12/2003 | Phan | H04N 9/30 345/694 |
| 8,446,435 | B2 * | 5/2013 | Tomizawa | G09G 3/2003 345/690 |
| 8,648,888 | B2 * | 2/2014 | Natori | G09F 9/33 345/694 |
| 2003/0043326 | A1 | 3/2003 | Sawasaki et al. | |
| 2004/0021677 | A1 * | 2/2004 | Sasaki | G09G 3/3611 345/694 |
| 2004/0212633 | A1 * | 10/2004 | Natori | G09F 9/33 345/694 |
| 2004/0234163 | A1 * | 11/2004 | Lee | G06T 3/4092 382/298 |
| 2009/0027425 | A1 | 1/2009 | Park et al. | |
| 2009/0135207 | A1 | 5/2009 | Tseng et al. | |
| 2009/0160747 | A1 | 6/2009 | Morisue et al. | |
| 2011/0007103 | A1 | 1/2011 | Han et al. | |
| 2011/0084287 | A1 | 4/2011 | Lee | |
| 2011/0254759 | A1 * | 10/2011 | Mori | G09G 3/3607 345/88 |
| 2012/0113069 | A1 * | 5/2012 | Kwon | G09G 3/3611 345/204 |
| 2012/0206512 | A1 * | 8/2012 | Kim | G02F 1/133514 345/691 |
| 2013/0070007 | A1 | 3/2013 | Park et al. | |
| 2014/0139411 | A1 * | 5/2014 | Jinta | G09G 3/3233 345/80 |
| 2014/0152714 | A1 * | 6/2014 | Nakagawa | H04N 9/67 345/690 |
| 2015/0235587 | A1 * | 8/2015 | Su | G09G 3/2003 345/694 |
| 2015/0294628 | A1 * | 10/2015 | Nakagawa | G09G 3/3607 345/694 |
| 2015/0302814 | A1 * | 10/2015 | Shiomi | G09G 3/3607 345/694 |
| 2016/0035263 | A1 * | 2/2016 | Guo | G02F 1/1362 345/593 |
| 2016/0035265 | A1 * | 2/2016 | Park | G09G 3/2003 345/694 |
| 2016/0048053 | A1 * | 2/2016 | Kim | G02F 1/133514 345/694 |

FOREIGN PATENT DOCUMENTS

| | | | |
|---|---|---|---|
| CN | 101188101 | A | 5/2008 |
| CN | 101370148 | A | 2/2009 |
| CN | 101630498 | A | 1/2010 |
| CN | 102160112 | A | 8/2011 |
| CN | 102194429 | A | 9/2011 |
| CN | 102339587 | A | 2/2012 |
| CN | 102460544 | A | 5/2012 |
| CN | 102741907 | A | 10/2012 |
| CN | 103257494 | A | 8/2013 |
| CN | 103280162 | A | 9/2013 |
| CN | 103544901 | A | 1/2014 |
| JP | 2011197084 | A | 10/2011 |
| WO | 2011036916 | A1 | 3/2011 |
| WO | 2012137819 | A1 | 10/2012 |

OTHER PUBLICATIONS

2nd Office Action issued in Chinese Application No. 201410057477.3 dated Jan. 5, 2016.

* cited by examiner

| | $K_{B1}$ | $K_{B2}$ | $K_{B3}$ | $K_{G1}$ | $K_{G2}$ | $K_{G3}$ | $K_{R1}$ | $K_{R2}$ | $K_{R3}$ |
|---|---|---|---|---|---|---|---|---|---|
| (1) | [0.1; | 0.8; | 0.1;] | [0.1; | 0.8; | 0.1;] | [0.1; | 0.8; | 0.1;] |
| (2) | [0.15; | 0.7; | 0.15;] | [0.15; | 0.7; | 0.15;] | [0.15; | 0.7; | 0.15;] |
| (3) | [0.2; | 0.6; | 0.2;] | [0.2; | 0.6; | 0.2;] | [0.2; | 0.6; | 0.2;] |
| (4) | [0.25; | 0.5; | 0.25;] | [0.25; | 0.5; | 0.25;] | [0.25; | 0.5; | 0.25;] |
| (5) | [0.1; | 0.8; | 0.1;] | [0.15; | 0.7; | 0.15;] | [0.1; | 0.8; | 0.1;] |
| (6) | [0.15; | 0.7; | 0.15;] | [0.1; | 0.8; | 0.1;] | [0.15; | 0.7; | 0.15;] |
| (7) | [0.2; | 0.6; | 0.2;] | [0.2; | 0.6; | 0.2;] | [0.25; | 0.5; | 0.25;] |
| (8) | [0.25; | 0.5; | 0.25;] | [0.25; | 0.5; | 0.25;] | [0.2; | 0.6; | 0.2;] |

FIG.5

| | S1 | S2 | S3 | S4 | S5 | S6 | S7 | S8 | S9 | S10 | S11 | S12 | S13 | S14 | S15 | S16 | S17 | S18 |
|---|---|---|---|---|---|---|---|---|---|---|---|---|---|---|---|---|---|---|
| G1 | R | B | G | R | B | G | R | B | G | R | B | G | R | B | G | R | B | G |
| G2 | G | R | B | G | R | B | G | R | B | G | R | B | G | R | B | G | R | B |
| G3 | R | B | G | R | B | G | R | B | G | R | B | G | R | B | G | R | B | G |
| G4 | G | R | B | G | R | B | G | R | B | G | R | B | G | R | B | G | R | B |
| G5 | R | B | G | R | B | G | R | B | G | R | B | G | R | B | G | R | B | G |
| G6 | G | R | B | G | R | B | G | R | B | G | R | B | G | R | B | G | R | B |

FIG.6

| | $K_{R1}$ $K_{R2}$ $K_{R3}$ $K_{R4}$ $K_{R5}$ | $K_{G1}$ $K_{G2}$ $K_{G3}$ $K_{G4}$ $K_{G5}$ | $K_{B1}$ $K_{B2}$ $K_{B3}$ $K_{B4}$ $K_{B5}$ |
|---|---|---|---|
| (1) | [0.02; 0.08; 0.8; 0.08; 0.02;] | [0.02; 0.08; 0.8; 0.08; 0.02;] | [0.02; 0.08; 0.8; 0.08; 0.02;] |
| (2) | [0.05; 0.1; 0.7; 0.1; 0.05;] | [0.05; 0.1; 0.7; 0.1; 0.05;] | [0.05; 0.1; 0.7; 0.1; 0.05;] |
| (3) | [0.05;0.15;0.6; 0.15; 0.05;] | [0.05;0.15;0.6; 0.15; 0.05;] | [0.05;0.15;0.6; 0.15; 0.05;] |
| (4) | [0.05; 0.2; 0.5; 0.2; 0.05;] | [0.05; 0.2; 0.5; 0.2; 0.05;] | [0.05; 0.2; 0.5; 0.2; 0.05;] |
| (5) | [0.02; 0.08; 0.8; 0.08; 0.02;] | [0.05; 0.1; 0.7; 0.1; 0.05;] | [0.02; 0.08; 0.8; 0.08; 0.02;] |
| (6) | [0.05; 0.1; 0.7; 0.1; 0.05;] | [0.02; 0.08; 0.8; 0.08; 0.02;] | [0.05; 0.1; 0.7; 0.1; 0.05;] |
| (7) | [0.05;0.15;0.6; 0.15; 0.05;] | [0.05;0.15;0.6; 0.15; 0.05;] | [0.05; 0.2; 0.5; 0.2; 0.05;] |
| (8) | [0.05; 0.2; 0.5; 0.2; 0.05;] | [0.05; 0.2; 0.5; 0.2; 0.05;] | [0.05;0.15;0.6; 0.15; 0.05;] |

| | $K_{R1}$ | $K_{R2}$ | $K_{R3}$ | $K_{G1}$ | $K_{G2}$ | $K_{G3}$ | $K_{B1}$ | $K_{B2}$ | $K_{B3}$ |
|---|---|---|---|---|---|---|---|---|---|
| (1) | [0.1; | 0.8; | 0.1;] | [0.1; | 0.8; | 0.1;] | [0.1; | 0.8; | 0.1;] |
| (2) | [0.15; | 0.7; | 0.15;] | [0.15; | 0.7; | 0.15;] | [0.15; | 0.7; | 0.15;] |
| (3) | [0.2; | 0.6; | 0.2;] | [0.2; | 0.6; | 0.2;] | [0.2; | 0.6; | 0.2;] |
| (4) | [0.25; | 0.5; | 0.25;] | [0.25; | 0.5; | 0.25;] | [0.25; | 0.5; | 0.25;] |
FIG.15
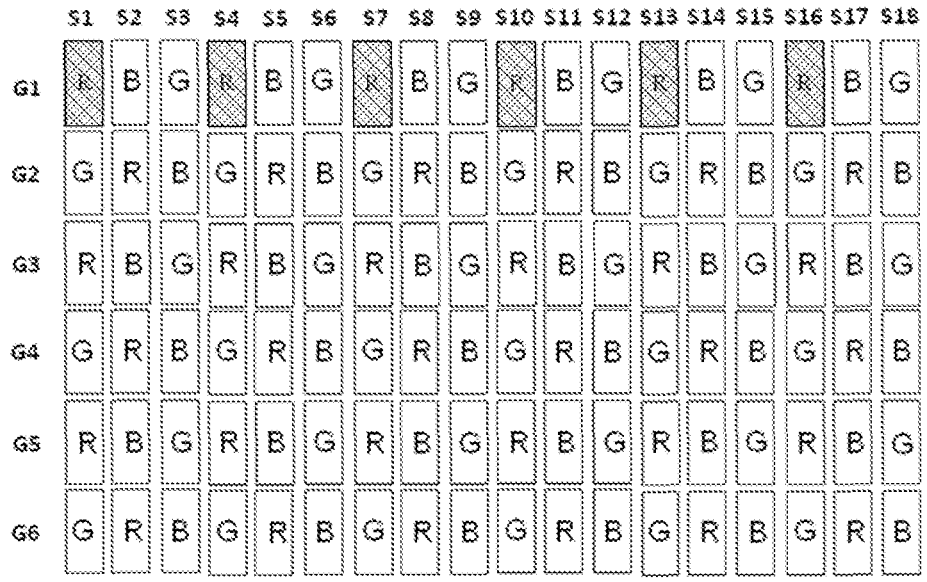
FIG.16
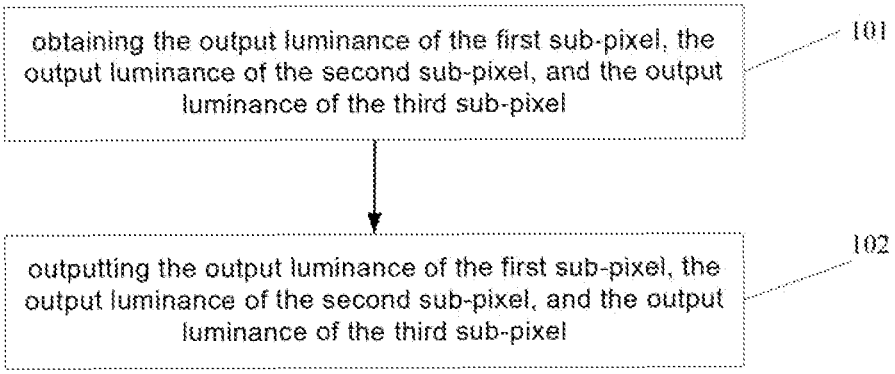
FIG.17

DISPLAY SUBSTRATE AND DRIVING METHOD THEREOF AND DISPLAY DEVICE

FIELD OF THE INVENTION

The invention relates to the field of display technology, in particular, to a display substrate and a driving method thereof, and a display device.

BACKGROUND OF THE INVENTION

Currently, conventional design of pixels in a display device is a RGB (red, green, and blue) design or a RGBW (red, green, blue, and white) design. In the RGB design, three sub-pixels are combined into a pixel for displaying, and in the RGBW design, four sub-pixels are combined into a pixel for displaying. In above designs, a physical resolution of a display device is an actual resolution. However, with the increase of user's requirement on feeling of the display device, the manufacturer has to continuously increase the pixels per inch (PPI) of the display device to meet this requirement, and thus there is a great challenge in designing and manufacturing process. When the manufacturing process has reached a limit, other technologies are needed to increase the human visual resolution, and thus a virtual driving technology emerges in the display industry.

Regarding the solution of combining three sub-pixels into a pixel unit for displaying in the prior art, as a pixel unit is composed of three sub-pixels, when a certain number of such pixels are used to display, too many sub-pixels are needed, thus resulting in a complicated manufacturing process and a high defective rate of product.

SUMMARY OF THE INVENTION

The invention provides a display substrate and a driving method thereof, and a display device, which carp simplify the manufacturing process and decrease the defective rate of product.

To achieve above objects, the invention provides a display substrate comprising a plurality of rows of pixel units or a plurality of columns of pixel units, wherein each row of pixel units or each column of pixel units include first pixel units and second pixel units which are arranged alternately, one first pixel unit and one second pixel unit are composed of three sub-pixels, and wherein the first pixel unit includes a first sub-pixel and a second sub-pixel, the second pixel unit includes the second sub-pixel and a third sub-pixel, and the first sub-pixel, the second sub-pixel and the third sub-pixel are arranged in turn.

Optionally, when the second sub-pixel includes a red sub-pixel, the first sub-pixel includes a green sub-pixel and the third sub-pixel includes a blue sub-pixel, or the first sub-pixel includes a blue sub-pixel and the third sub-pixel includes a green sub-pixel; or when the second sub-pixel includes a green sub-pixel, the first sub-pixel includes a red sub-pixel and the third sub-pixel includes a blue sub-pixel, or the first sub-pixel includes a blue sub-pixel and the third sub-pixel includes a red sub-pixel; or when the second sub-pixel includes a blue sub-pixel, the first sub-pixel includes a red sub-pixel and the third sub-pixel includes a green sub-pixel, or the first sub-pixel includes a green sub-pixel and the third sub-pixel includes a red sub-pixel.

Optionally, the first sub-pixels, the second sub-pixels, and the third sub-pixels are arranged repeatedly in turn on a basis of a 2×3 matrix constructed by two adjacent pixel rows.

To achieve above objects, the invention provides a display device comprising above display substrate.

To achieve above objects, the invention provides a driving method of a display substrate, wherein the display substrate comprises a plurality of rows of pixel units or a plurality of columns of pixel units, wherein each row of pixel units or each column of pixel units include first pixel units and second pixel units which are arranged alternately, one first pixel unit and one second pixel unit are composed of three sub-pixels, and wherein the first pixel unit includes a first sub-pixel and a second sub-pixel, the second pixel unit includes the second sub-pixel and a third sub-pixel, and the first sub-pixel, the second sub-pixel and the third sub-pixel are arranged in turn, wherein, the driving method comprises:

obtaining an output luminance of the first sub-pixel, an output luminance of the second sub-pixel, and an output luminance of the third sub-pixel; and outputting the output luminance of the first sub-pixel, the output luminance of the second sub-pixel, and the output luminance of the third sub-pixel.

Optionally, obtaining an output luminance of the first sub-pixel, an output luminance of the second sub-pixel, and an output luminance of the third sub-pixel comprises:

adding a luminance value of the first sub-pixel to a luminance value of at least one first common pixel to generate the output luminance of the first sub-pixel, wherein the luminance value of the first sub-pixel is a product of a self luminance value of the first sub-pixel and a corresponding proportional value, the luminance value of the at least one first common pixel is a product of a self luminance value of the at least one first common pixel and a corresponding proportional value, and the at least one first common pixel is adjacent to the first sub-pixel and has the same color as the first sub-pixel;

adding a luminance value of the second sub-pixel to a luminance value of at least one second common pixel to generate the output luminance of the second sub-pixel, wherein the luminance value of the second sub-pixel is a product of a self luminance value of the second sub-pixel and a corresponding proportional value, the luminance value of the at least one second common pixel is a product of a self luminance value of the at least one second common pixel and a corresponding proportional value, and the at least one second common pixel is adjacent to the second sub-pixel and has the same color as the second sub-pixel; and adding a luminance value of the third sub-pixel to a luminance value of at least one third common pixel to generate the output luminance of the third sub-pixel, wherein the luminance value of the third sub-pixel is a product of a self luminance value of the third sub-pixel and a corresponding proportional value, the luminance value of the at least one third common pixel is a product of a self luminance value of the at least one third common pixel and a corresponding proportional value, and the at least one third common pixel is adjacent to the third sub-pixel and has the same color as the third sub-pixel.

Optionally, when the first sub-pixel is at a non-edge position, the number of the at least one first common pixel is more than one; when the second sub-pixel is at a non-edge position, the number of the at least one second common pixel is more than one; and when the third sub-pixel is at a non-edge position, the number of the at least one third common pixel is more than one.

Optionally, when the first sub-pixel is at an edge position, the number of the at least one first common pixel is one; when the second sub-pixel is at an edge position, the number of the at least one second common pixel is one; and when the third sub-pixel is at an edge position, the number of the at least one third common pixel is one.

Optionally, the at least one first common pixel is located in a row or a column where the first sub-pixel is located, the at least one second common pixel is located in a row or a column where the second sub-pixel is located, and the at least one third common pixel is located in a row or a column where the third sub-pixel is located.

Optionally, a sum of the proportional value corresponding to the self luminance value of the first sub-pixel and the proportional value corresponding to the self luminance value of the at least one first common pixel is one;

a sum of the proportional value corresponding to the self luminance value of the second sub-pixel and the proportional value corresponding to the self luminance value of the at least one second common pixel is one; and a sum of the proportional value corresponding to the self luminance value of the third sub-pixel and the proportional value corresponding to the self luminance value of the at least one third common pixel is one.

Advantages of the invention are as follows:

In the display substrate and the driving method thereof, and the display device in the invention, the first pixel unit includes a first sub-pixel and a second sub-pixel, and the second pixel unit includes the second sub-pixel and a third sub-pixel. That is, in the invention, three sub-pixels form two pixel units, thus the number of the sub-pixels needed to form a certain number of pixel units is decreased, and the manufacturing process is simplified and the defective rate of product is decreased.

BRIEF DESCRIPTION OF THE DRAWINGS

FIG. 5 is diagram of proportional values corresponding to the self luminance values of sub-pixels according to the first embodiment;

FIG. 6 is an another diagram illustrating how to calculate an output luminance of a red sub-pixel according to the first embodiment;

FIG. 15 is diagram of proportional values corresponding to the self luminance values of sub-pixels according to the third embodiment;

FIG. 16 is an another diagram illustrating how to calculate an output luminance of a red sub-pixel according to the third embodiment; and FIG. 17 is a flowchart of a driving method of the display substrate according to the fifth embodiment.

DETAILED DESCRIPTION OF THE EMBODIMENTS

In order to make a person skilled in the art understand solutions in the invention better, hereinafter, descriptions of a display substrate and a driving method thereof, and a display device will be described in detail in conjunction with drawings.

Figure 1:
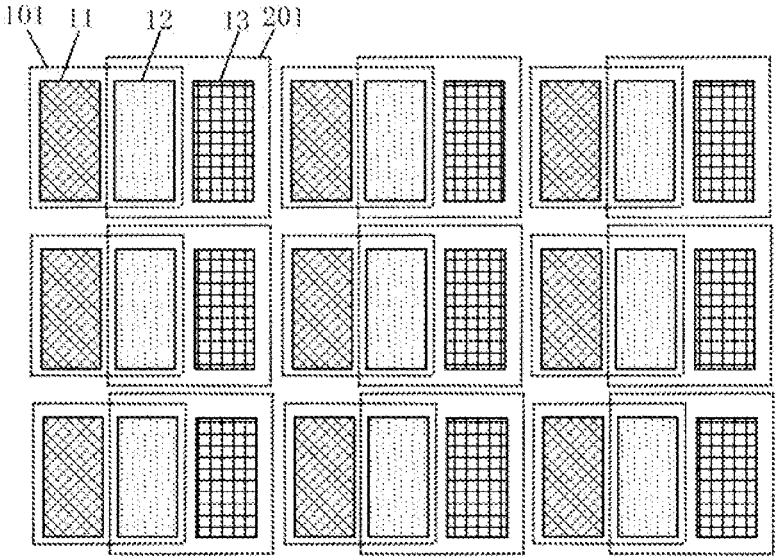
FIG. 1 is a structural diagram of a display substrate according to the first embodiment of the invention.

FIG. 1 is a structural diagram of a display substrate according to the first embodiment of the invention. As shown in FIG. 1, the display substrate comprises first pixel units 101 and second pixel units 201 which are arranged alternately, wherein one first pixel unit 101 includes a first sub-pixel 11 and a second sub-pixel 12, one second pixel unit 201 includes the second sub-pixel 12 and a third sub-pixel 13, and the first sub-pixel 11, the second sub-pixel 12 and the third sub-pixel 13 are arranged in turn The display substrate in the embodiment is a RGB display substrate, that is, the display substrate comprises three kinds of sub-pixels, red sub-pixels green sub-pixels and blue sub-pixels, wherein R indicates red sub-pixels. G indicates green sub-pixels and B indicates blue sub-pixels.

Optionally, when the second sub-pixel 12 includes a red sub-pixel, the first sub-pixel 11 includes a green sub-pixel and the third sub-pixel 13 includes a blue sub-pixel, at this time, in a row of pixels, the first sub-pixel 11, the second sub-pixel 12, and the third sub-pixel 13 are arranged in turn in the order of the green sub-pixel, the red sub-pixel and the blue sub-pixel; or, when the second sub-pixel 12 includes a red sub-pixel, the first sub-pixel 11 includes a blue sub-pixel and the third sub-pixel 13 includes a green sub-pixel, at this time, in a row of pixels, the first sub-pixel 11 the second sub-pixel 12, and the third sub-pixel 13 are arranged in turn in the order of the blue sub-pixel, the red sub-pixel and the green sub-pixel.

Optionally, when the second sub-pixel 12 includes a green sub-pixel, the first sub-pixel 11 includes a red sub-pixel and the third sub-pixel 13 includes a blue sub-pixel, at this time, in a row of pixels, the first sub-pixel 11, the second sub-pixel 12, and the third sub-pixel 13 are arranged in turn in the order of the red sub-pixel, the green sub-pixel and the blue sub-pixel; or, when the second sub-pixel 12 includes a green sub-pixel, the first sub-pixel 11 includes a blue sub-pixel and the third sub-pixel 13 includes a red sub-pixel; at this time, in a row of pixels, the first sub-pixel 11, the second sub-pixel 12, and the third sub-pixel 13 are arranged in turn in the order of the blue sub-pixel, the green sub-pixel and the red sub-pixel.

Optionally, when the second sub-pixel 12 includes a blue sub-pixel, the first sub-pixel 11 includes a red sub-pixel and the third sub-pixel 13 includes a green sub-pixel, at this time, in a row of pixels, the first sub-pixel 11, the second sub-pixel 12, and the third sub-pixel 13 are arranged in turn in the order of the red sub-pixel, the blue sub-pixel, and the green sub-pixel; or, when the second sub-pixel 12 includes a blue sub-pixel, the first sub-pixel 11 includes a green sub-pixel and the third sub-pixel 13 includes a red sub-pixel, at this time, in a row of pixels, the first sub-pixel 11, the second sub-pixel 12, and the third sub-pixel 13 are arranged in turn in the order of the green sub-pixel, the blue sub-pixel and the red sub-pixel.

Figure 2:
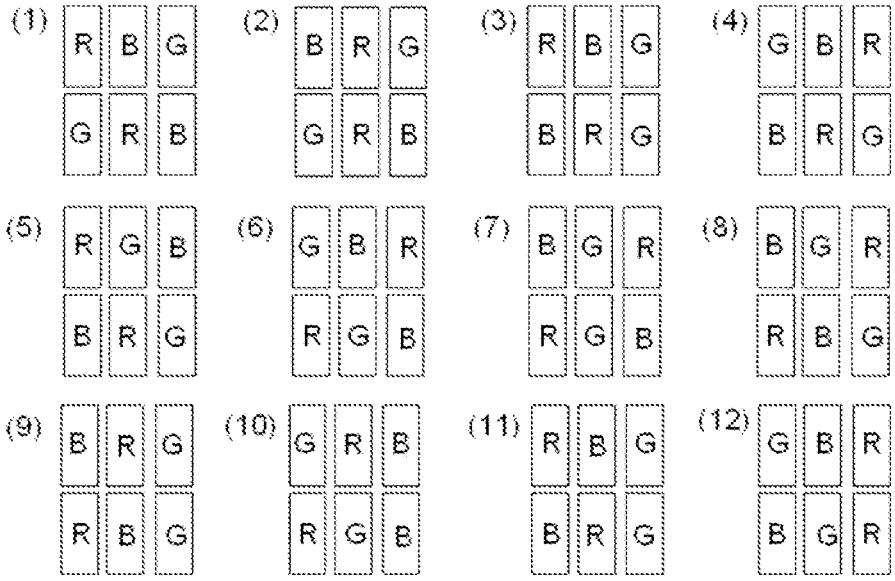
FIG. 2 is a diagram illustrating arrangement of the sub-pixels in the first embodiment.

Optionally, in the embodiment, the first sub-pixels 11, the second sub-pixels 12, and the third sub-pixels 13 are arranged repeatedly in turn on a basis of a 2×3 matrix constructed by two adjacent pixel rows. FIG. 2 is a diagram illustrating arrangement of sub-pixels according to the first embodiment, and FIG. 2 shows 12 repeating units for repeatedly arranging sub-pixels, each repeating unit forms into a 2×3 matrix, that is to say, sub-pixels of the display substrate are arranged repeatedly on basis of repeating units shown in FIG. 2. As shown in FIG. 2, R indicates a red sub-pixel, G indicates a green sub-pixel, and B indicates a blue sub-pixel. With respect to the arrangement (1) shown in FIG. 2, in one repeating unit, in the first row of pixels, the red sub-pixel, the blue sub-pixel and the green sub-pixel are arranged in turn in this order, and in the second row of pixels, the green sub-pixel, the red sub-pixel and the blue sub-pixel are arranged in turn in this order. With respect to the arrangement (2) shown in FIG. 2, in one repeating unit, in the first row of pixels, the blue sub-pixel, the red sub-pixel and the green sub-pixel are arranged in turn in this order, and in the second row of pixels, the green sub-pixel, the red sub-pixel and the blue sub-pixel are arranged in turn in this order. The remaining arrangements (3)-(12) can be referred to FIG. 2, and descriptions thereof are omitted. Of course, in addition to the 12 arrangements, sub-pixels may be arranged in other patterns, so long as each row of each repeating unit comprises a blue sub-pixel, a red sub-pixel and a green sub-pixel.

In the embodiment, an output luminance of the first sub-pixel 11 is a sum of the luminance value of the first sub-pixel 11 and a luminance value of at least one first common pixel, wherein the luminance value of the first sub-pixel 11 is a product of a self luminance value of the first sub-pixel 11 and a proportional value corresponding thereto, and the luminance value of at least one first common pixel is a product of a self luminance value of the at least one first common pixel and a proportional value corresponding thereto, and the at least one first common pixel is sub-pixel which is adjacent to the first sub-pixel 11 and has the same color as the first sub-pixel. Preferably, when the first sub-pixel 11 is at a non-edge position, the number of the at least one first common pixel is more than one, and when the first sub-pixel 11 is at an edge position, the number of the at least one first common pixel is one. The at least one first common pixel is located in a row or a column where the first sub-pixel 11 is located, that is, the first common pixel may be a sub-pixel which is adjacent to the first sub-pixel 11 in row direction and has the same color as the first sub-pixel 11, or may be a sub-pixel which is adjacent to the first sub-pixel 11 in column direction and has the same color as the first sub-pixel 11. Preferably, a sum of the proportional value corresponding to the self luminance value of the first sub-pixel 11 and the proportional value corresponding to the self luminance value of the at least one first common pixel is one.

It should be noted, a sub-pixel positioned at an edge position refers to a sub-pixel in the first one or the last one repeating unit in each row of pixels, such as the first or last red sub-pixel in each row of pixels, the first or last green sub-pixel in each row of pixels, and the first or last blue sub-pixel in each row of pixels. Optionally, sub-pixels positioned at an edge position may also be sub-pixels in the first two or the last two repeating unit in each row of pixels, such as the first two or last two red sub-pixels in each row of pixels, the first two or last two green sub-pixels in each row of pixels, and the first two or last two blue sub-pixels in each row of pixels. Accordingly, the sub-pixel at a non-edge position refers to a sub-pixel other than the sub-pixel positioned at the edge position.

In the embodiment, an output luminance of the second sub-pixel 12 is a sum of the luminance value of the second sub-pixel 12 and a luminance value of at least one second common pixel, wherein the luminance value of the second sub-pixel 12 is a product of a self luminance value of the second sub-pixel 12 and a proportional value corresponding thereto, and the luminance value of at least one second common pixel is a product of a self luminance value of the at least one second common pixel and a proportional value corresponding thereto, and the at least one second common pixel is sub-pixel which is adjacent to the second sub-pixel 12 and has the same color as the second sub-pixel. Preferably, when the second sub-pixel 12 is at a non-edge position, the number of the at least one second common pixel is more than one, and when the second sub-pixel 12 is at an edge position, the number of the at least one second common pixel is one. The at least one second common pixel is located in a row or a column where the second sub-pixel 12 is located, that is, the second common pixel may be a sub-pixel which is adjacent to the second sub-pixel 12 in row direction and has the same color as the second sub-pixel 12, or may be a sub-pixel which is adjacent to the second sub-pixel 12 in column direction and has the same color as the second sub-pixel 12. Preferably, a sum of the proportional value corresponding to the self luminance value of the second sub-pixel 12 and the proportional value corresponding to the self luminance value of the at least one second common pixel is one.

In the embodiment, an output luminance of the third sub-pixel 13 is a sum of the luminance value of the third sub-pixel 13 and a luminance value of at least one third common pixel, wherein the luminance value of the third sub-pixel 13 is a product of a self luminance value of the third sub-pixel 13 and a proportional value corresponding thereto, and the luminance value of at least one third common pixel is a product of a self luminance value of the at least one third common pixel and a proportional value corresponding thereto, and the at least one third common pixel is sub-pixel which is adjacent to the third sub-pixel 13 and has the same color as the third sub-pixel. Preferably, when the third sub-pixel 13 is at a non-edge position, the number of the at least one third common pixel is more than one, and when the third sub-pixel 13 is at an edge position, the number of the at least one third common pixel is one. The at least one third common pixel is located in a row or a column where the third sub-pixel 13 is located, that is, the third common pixel may be a sub-pixel which is adjacent to the third sub-pixel 13 in row direction and has the same color as the third sub-pixel 13 or may be a sub-pixel which is adjacent to the third sub-pixel 13 in column direction and has the same color as the third sub-pixel 13. Preferably, a sum of the proportional value corresponding to the self luminance value of the third sub-pixel 13 and the proportional value corresponding to the self luminance value of the at least one third common pixel is one.

Hereinafter, taking a display substrate adopting the arrangement (1) as an example, procedures of calculating output luminance of the sub-pixels in the display substrate are described in detail.

Figure 3:
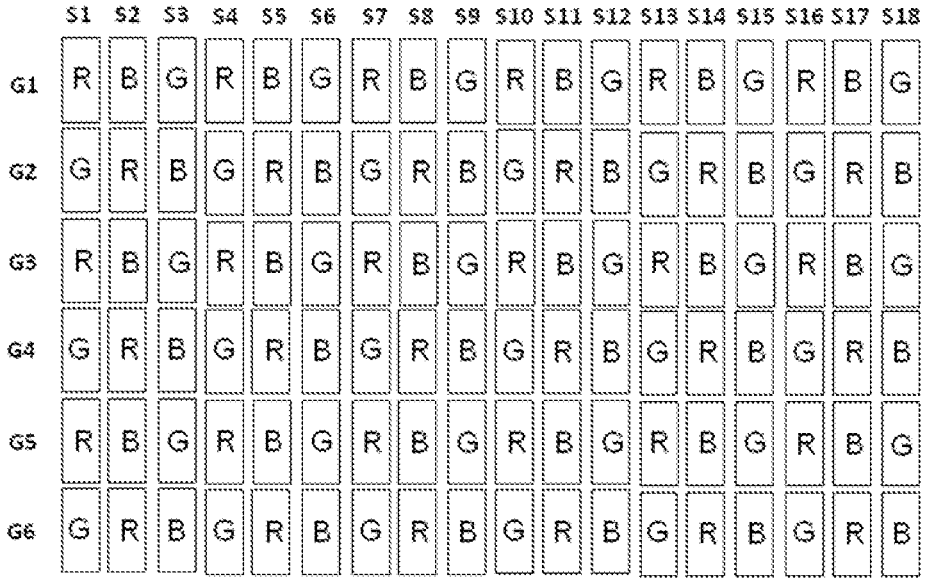
FIG. 3 is a specific structural diagram of the display substrate according to the first embodiment.

In one repeating unit, in the first row of pixels, when the second sub-pixel 12 includes a blue sub-pixel, the first sub-pixel 11 includes a red sub-pixel, and the third sub-pixel 11 includes a green sub-pixel; in the second row of pixels, when the second sub-pixel 12 includes a red sub-pixel, the first sub-pixel 11 includes a green sub-pixel, and the third sub-pixel 11 includes a blue sub-pixel. Therefore, in one repeating unit, in the first row of pixels, the output luminance of the first sub-pixel 11 is the output luminance of the red sub-pixel, the output luminance of the second sub-pixel 12 is the output luminance of the blue sub-pixel, and the output luminance of the third sub-pixel 13 is the output luminance of the green sub-pixel; in the second row of pixels, the output luminance of the first sub-pixel 11 is the output luminance of the green sub-pixel, the output luminance of the second sub-pixel 12 is the output luminance of the red sub pixel and the output luminance of the third sub-pixel 13 is the output luminance of the blue sub-pixel. FIG. 3 is a specific structural diagram of the display substrate in the first embodiment. As shown in FIG. 3, red sub-pixels, blue sub-pixels and green sub-pixels are repeatedly arranged in turn by taking two rows of pixels as a cycle. In one cycle, a first row of pixels are formed by repeatedly arranging a red sub-pixel, a blue sub-pixel and a blue sub-pixel therein in turn in this order, and a second row of pixels are formed by repeatedly arranging a green sub-pixel, a red sub-pixel and a blue sub-pixel therein in turn in this order. In FIG. 3, taking 6 rows and 18 columns of sub-pixels as an example, wherein, the 6 rows of pixels are pixel row G1 to pixel row G6 respectively, the 18 columns of pixels are pixel column S1 to pixel column S18 respectively, for example, S1G1 indicates position where a red pixel sub-pixel in row G1 and column S1 is located, S7G1 indicates position where a red pixel sub-pixel in row G1 and column S7 is located, and so on.

Figure 4:
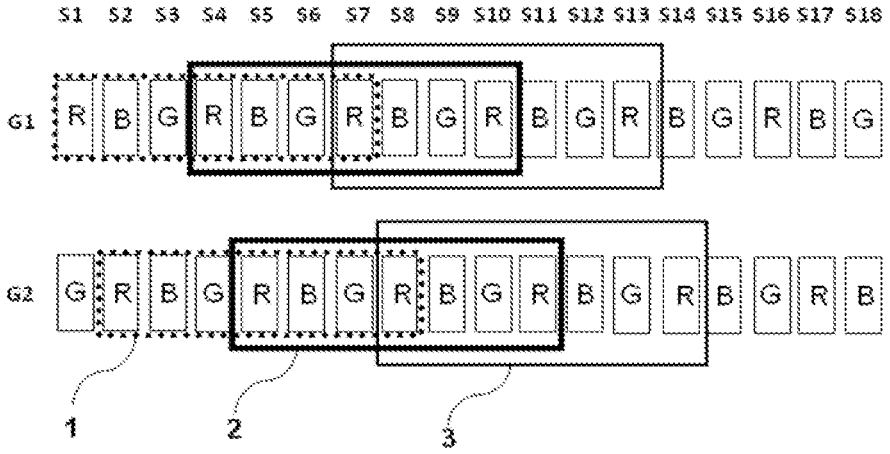
FIG. 4 is a diagram illustrating how to calculate an output luminance of a red sub-pixel according to the first embodiment.

FIG. 4 is a diagram illustrating how to calculate an output luminance of a red sub-pixel according to the first embodiment. As shown in FIG. 4, two rows of pixels in one cycle are exemplified, and FIG. 4 is a diagram illustrating calculation of an output luminance of a red sub-pixel at a non-edge position in each row of pixels. In each row of pixels, one red sub-pixel at a non-edge position has two adjacent red sub-pixels, that is, two red sub-pixels which are in the same row as the red sub-pixel and are closest to the red sub-pixel at two sides thereof respectively. These two adjacent red sub-pixels are common pixels of the red sub-pixel. In order to show the relationship between the red sub-pixel and its adjacent red sub-pixels, a plurality of regions are shown by blocks in FIG. 4, for example, in the second row of pixels, region 1 includes 7 sub-pixels, wherein the red sub-pixel at S5G2 is at the center of the region 1, the red sub-pixel at S2G2 and the red sub-pixel at S8G2 are adjacent red sub-pixels thereof, and these two adjacent red sub-pixels are at edge positions of the region 1. Therefore, the output luminance of the red sub-pixel at S5G2 is: C (S5G2)=$K_{R1}$×L (S2G2)+$K_{R2}$×L (S5G2)+$K_{R3}$×L (S8G2), wherein L (S2G2) is a self luminance value of the red sub-pixel at S2G2, L (S5G2) is a self luminance value of the red sub-pixel at S5G2, L (S8G2) is a self luminance value of the red sub-pixel at S8G2, $K_{R1}$ is a proportional value corresponding to the self luminance value of the red sub-pixel at S2G2, $K_{R2}$ is a proportional value corresponding to the self luminance value of the red sub-pixel at S5G2, and $K_{R3}$ is a proportional value corresponding to the self luminance value of the red sub-pixel at S8G2. FIG. 5 is diagram of proportional values corresponding to the self luminance values of sub-pixels according to the first embodiment. As shown in FIG. 5, 8 groups of proportional values are listed, that is, group (1) of proportional values to group (8) of proportional values, each group of proportional values comprise: a proportional value corresponding to one red sub-pixel $K_{R2}$, a proportional value corresponding to one adjacent red sub-pixel $K_{R1}$, a proportional value corresponding to the other adjacent red sub-pixel $K_{R3}$, a proportional value corresponding to one green sub-pixel $K_{G2}$, a proportional value corresponding to one adjacent green sub-pixel $K_{G1}$, a proportional value corresponding to the other adjacent green sub-pixel $K_{G3}$, a proportional value corresponding to one blue sub-pixel $K_{B2}$, a proportional value corresponding to one adjacent blue sub-pixel $K_{B1}$, and a proportional value corresponding to the other adjacent blue sub-pixel $K_{B3}$. In practical application, any one of these groups of proportional values may be selected to calculate the output luminance of sub-pixels, of course, other proper proportional values are applicable as long as a sum of proportional values for each color in each group is one. In the embodiment, the group (1) of proportional values are preferably adopted, and in above equation of C (S5G2) for the output luminance of the red sub-pixel, if $K_{R1}$ is 0.1. $K_{R2}$ is 0.8, and $K_{R3}$ is 0.1, then C (S5G2)=0.1×L (S2G2)+0.8×L (S5G2)+0.1×(S8G2). After verified by pictures, quality of the pictures displayed by the display substrate will be better if the group (1) of proportional values, group (2) of proportional values and the group (3) of proportional values are adopted, therefore, the group (1) of proportional values, the group (2) of proportional values and the group (3) of proportional values are preferable. Descriptions with respect to the output luminance of the red sub-pixels in region 2 and region 3 may refer to that with respect to region 1, and they will be omitted.

FIG. 6 is an another diagram illustrating how to calculate an output luminance of a red sub-pixel according to the first embodiment, and FIG. 6 is a diagram illustrating calculation of an output luminance of a red sub-pixel at an edge position in each row of pixels. In each row of pixels, one red sub-pixel at an edge position has one adjacent red sub-pixel which is in the same row as the red sub-pixel and closest to the red sub-pixel at one side thereof. The adjacent red sub-pixel is a common pixel of the red sub-pixel. For example, in the first row of pixels, the red sub-pixel at S1G1 is at an edge position, and the red sub-pixel at S4G1 is its adjacent red sub-pixel. Therefore, the output luminance of the red sub-pixel at S1G1 is: C (S1G1)=$K_{R11}$×L (S1G1)+$K_{R21}$×L (S4G1), wherein L (S1G1) is a self luminance value of the red sub-pixel at S1G1, L (S4G1) is a self luminance value of the red sub-pixel at S4G1, $K_{R11}$ is a proportional value corresponding to the self luminance value of the red sub-pixel at S1G1, $K_{R21}$ is a proportional value corresponding to the self luminance value of the red sub-pixel at S4G1. The $K_{R11}$ and $K_{R21}$ may adopt four groups of proportional values, that is, group (1) of proportional values to group (4) of proportional values. For example, group (1) of proportional values may be as follows: wherein, $K_{R11}$ is 0.7, and $K_{R21}$ is 0.3; group (2) of proportional values may be as follows: wherein, $K_{R11}$ is 0.6, and $K_{R21}$ is 0.4; group (3) of proportional values may be as follows: wherein, $K_{R11}$ is 0.8, and $K_{R21}$ is 0.2; and group (4) of proportional values may be as follows: wherein, $K_{R11}$ is 0.9, and $K_{R21}$ is 0.1. In practical application, any one of these groups of proportional values may be selected to calculate the output luminance of sub-pixels, of course, other proper proportional values are applicable as long as a sum of proportional values for each color in each group is one. In the embodiment, group (1) of proportional values are preferably adopted, and in above equation of C (S1G1) for the output luminance of the red sub-pixel, if $K_{R11}$ is 0.7, and $K_{R21}$ is 0.3, then C (S1G1) =0.7×L (S1G1)+0.3×L (S4G1). Calculations of other red sub-pixels at edge positions may refer to above calculation of the red sub-pixel at S1G1, as shown in FIG. 6, the other red sub-pixels at edge positions may include: the red sub-pixel at S2G2, the red sub-pixel at S1G3, the red sub-pixel at S2G4, the red sub-pixel at S1G5, and the red sub-pixel at S2G6.

Figure 7:
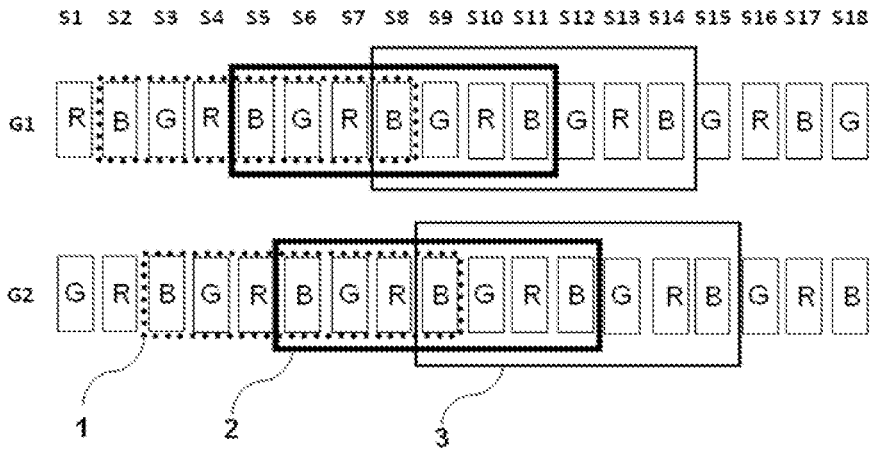
FIG. 7 is a diagram illustrating how to calculate an output luminance of a blue sub-pixel according to the first embodiment.

FIG. 7 is a diagram illustrating how to calculate an output luminance of a blue sub-pixel according to the first embodiment. As shown in FIG. 7, two rows of pixels in one cycle are exemplified, and FIG. 7 is a diagram illustrating calculation of an output luminance of a blue sub-pixel at a non-edge position in each row of pixels. In each row of pixels, one blue sub-pixel at a non-edge position has two adjacent blue sub-pixels, that is, two blue sub-pixels which are in the same row as the blue sub-pixel and are closest to the blue sub-pixel at two sides thereof respectively. These two adjacent blue sub-pixels are common pixels of the blue sub-pixel. In order to show the relationship between the blue sub-pixel and its adjacent blue sub-pixels, a plurality of regions are shown by blocks in FIG. 7, for example, in the second row of pixels, region 1 includes 7 sub-pixels, wherein the blue sub-pixel at S6G2 is at the center of the region 1, the blue sub-pixel at S3G2 and the blue sub-pixel at S9G2 are adjacent blue sub-pixels thereof, and these two adjacent blue sub-pixels are at edge positions of the region 1. Therefore, the output luminance of the blue sub-pixel at S6G2 is C (S6G2)=$K_{B1}$×L (S3G2)+$K_{B2}$×L (S6G2)+$K_{B3}$×L (S9G2) wherein L (S3G2) is a self luminance value of the blue sub-pixel at S3G2, L (S6G2) is a self luminance value of the blue sub-pixel at S6G2, L (S9G2) is a self luminance value of the blue sub-pixel at S9G2, $K_{B1}$ is a proportional value corresponding to the self luminance value of the blue sub-pixel at S3G2, $K_{B2}$ is a proportional value corresponding to the self luminance value of the blue sub-pixel at S6G2, and $K_{B3}$ a proportional value corresponding to the self luminance value of the blue sub-pixel at S9G2. As shown in FIG. 5, in the embodiment, group (1) of proportional values are preferably adopted, and in above equation of C (S6G2) for the output luminance of the blue sub-pixel, if $K_{B1}$ is 0.1, $K_{B2}$ is 0.8, and $K_{B3}$ is 0.1 then C (S6G2)=0.1×L (S3G2)+0.8×L (S6G2)+0.1×(S9G2). Descriptions with respect to the output luminance of the blue sub-pixels in region 2 and region 3 may refer to that with respect to region 1, and they will be omitted.

Figure 8:
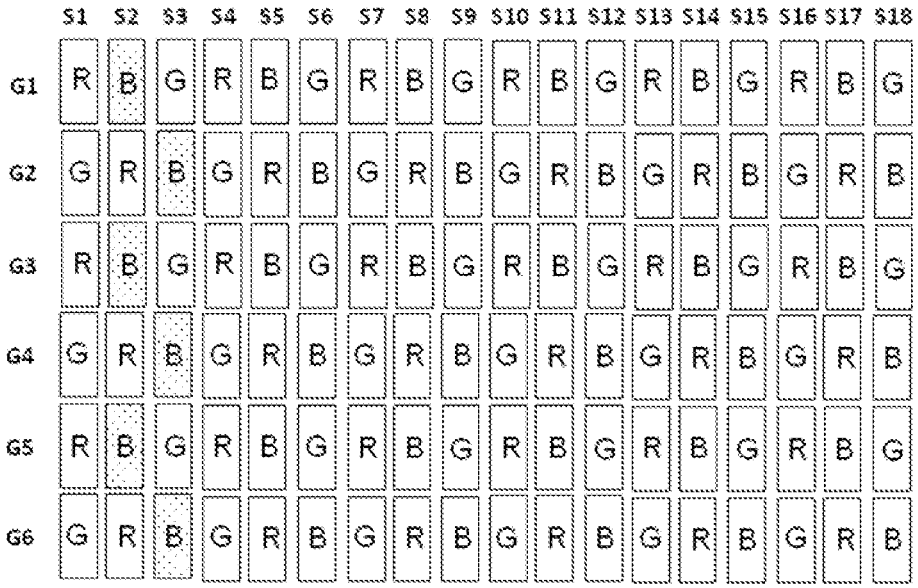
FIG. 8 is an another diagram illustrating how to calculate an output luminance of a blue sub-pixel according to the first embodiment.

FIG. 8 is an another diagram illustrating how to calculate an output luminance of a blue sub-pixel according to the first embodiment, and FIG. 8 is a diagram illustrating how to calculate an output luminance of a blue sub-pixel at an edge position in each row of pixels. In each row of pixels, one blue sub-pixel at an edge position has one adjacent blue sub-pixel which is in the same row as the blue sub-pixel and closest to the blue sub-pixel at one side thereof. The adjacent blue sub-pixel is a common pixel of the blue sub-pixel. For example, in the first row of pixels, the blue sub-pixel at S2G1 is at an edge position, and the blue sub-pixel at S5G1 is its adjacent blue sub-pixel. Therefore, the output luminance of the blue sub-pixel at S2G1 is: C (S2G1)=$K_{B11}$×L (S2G1)+$K_{B21}$×L (S5G1), wherein L (S2G1) is a self luminance value of the blue sub-pixel at S2G1, L (S5G1) is a self luminance value of the blue sub-pixel at S5G1, $K_{B11}$ is a proportional value corresponding to the self luminance value of the blue sub-pixel at S2G1, $K_{B21}$ is a proportional value corresponding to the self luminance value of the blue sub-pixel at S5G1. The $K_{B11}$ and $K_{B21}$ may adopt four groups of proportional values, that is, group (1) of proportional values to group (4) of proportional values. For example, group (1) of proportional values may be as follows: wherein, $K_{B11}$ is 0.7, and $K_{B21}$ is 0.3; group (2) of proportional values may be as follows: wherein, $K_{B11}$ is 0.6, and $K_{B21}$ is 0.4; group (3) of proportional values may be as follows: wherein, $K_{B11}$ is 0.8, and $K_{B21}$ is 0.2; and group (4) of proportional values may be as follows: wherein, $K_{B11}$ is 0.9, and $K_{B21}$ is 0.1. In practical application, any one of these groups of proportional values may be selected to calculate the output luminance of sub-pixels, of course, other proper proportional values are applicable as long as a sum of proportional values for each color in each group is one. In the embodiment, group (1) of proportional values are preferably adopted, and in above equation of C (S2G1) for the output luminance of the blue sub-pixel, if $K_{B11}$ is 0.7, and $K_{B21}$ is 0.3, then C(S2G1)=0.7×L (S2G1)+0.3×L (S5G1). Calculations of other blue sub-pixels at edge positions may refer to above calculation of the blue sub-pixel at S2G1, as shown in FIG. 8, the other blue sub-pixels at edge positions may include: the blue sub-pixel at S3G2, the blue sub-pixel at S2G3, the blue sub-pixel at S3G4, the blue sub-pixel at S2G5, and the blue sub-pixel at S3G6.

Figure 9:
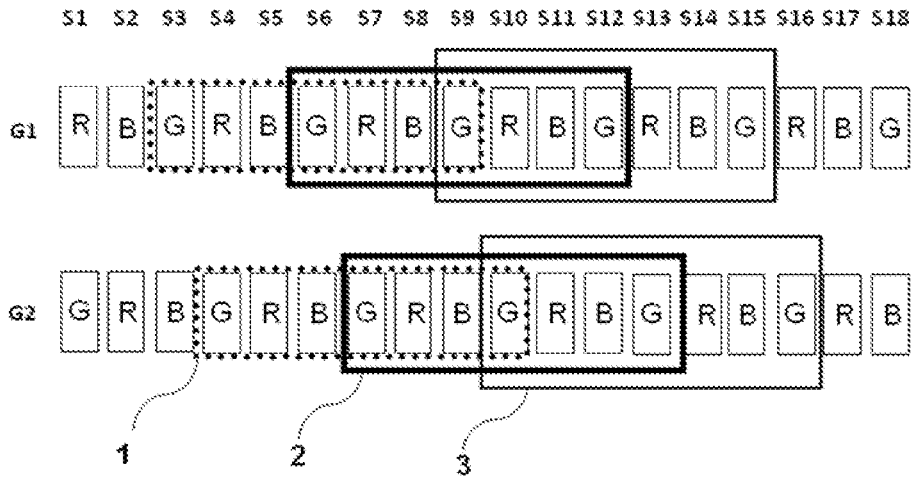
FIG. 9 is a diagram illustrating how to calculate an output luminance of a green sub-pixel according to the first embodiment.

FIG. 9 is a diagram illustrating how to calculate an output luminance of a green sub-pixel according to the first embodiment. As shown in FIG. 9, two rows f pixels in one cycle are exemplified, and FIG. 9 is a diagram illustrating calculation of an output luminance of a green sub-pixel at a non-edge position in each row of pixels. In each row of pixels, one green sub-pixel at a non-edge position has two adjacent green sub-pixels, that is, two green sub-pixels which are in the same row as the green sub-pixel and are closest to the green sub-pixel at two sides thereof respectively. These two adjacent green sub-pixels are common pixels of the green sub-pixel. In order to show the relationship between the green sub-pixel and its adjacent green sub-pixels, a plurality of regions are shown by blocks in FIG. 9, for example, in the second row of pixels, region 1 includes 7 sub-pixels, wherein the green sub-pixel at S7G2 is at the center of the region 1, the green sub-pixel at S4G2 and the green sub-pixel at S10G2 are adjacent green sub-pixels thereof, and these two adjacent green sub-pixels are at edge positions of the region 1. Therefore, the output luminance of the green sub-pixel at S7G2 is: C (S7G2) =$K_{G1}$×L (S4G2)+$K_{G2}$×L (S7G2)+$K_{G3}$×L (S10G2), wherein L (S4G2) is a self luminance value of the green sub-pixel at S4G2, L (S7G2) is a self luminance value of the green sub-pixel at S7G2. L (S10G2) is a self luminance value of the green sub-pixel at S10G2, $K_{G1}$ is a proportional value corresponding to the self luminance value of the green sub-pixel at S4G2, $K_{G2}$ is a proportional value corresponding to the self luminance value of the green sub-pixel at S7G2, and $K_{G3}$ a proportional value corresponding to the self luminance value of the green sub-pixel at S10G2. As shown in FIG. 5, in the embodiment, group (1) of proportional values are preferably adopted, and in above equation of C (S7G2) for the output luminance of the green sub-pixel, if $K_{G1}$ is 0.1, $K_{G2}$ is 0.8, and $K_{G3}$ is 0.1, then C (S7G2) =0.1×L (S4G2)+0.8×L (S7G2)+0.1×L (S10G2). Descriptions with respect to the output luminance of the green sub-pixels in region 2 and region 3 may refer to that with respect to region 1, and they will be omitted.

Figure 10:
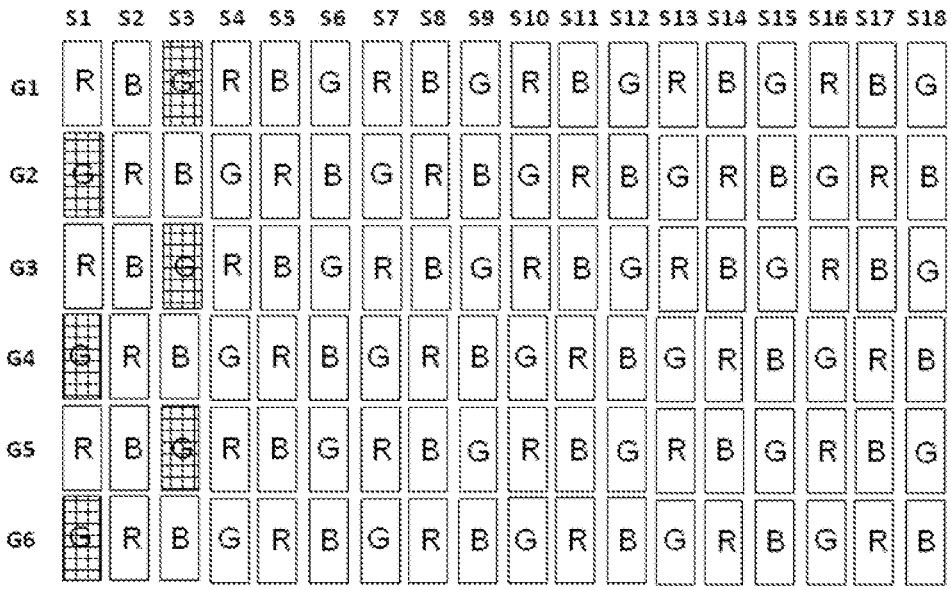
FIG. 10 is an another diagram illustrating how to calculate an output luminance of a green sub-pixel according to the first embodiment.

FIG. 10 is an another diagram illustrating haw to calculate an output luminance of a green sub-pixel according to the first embodiment, and FIG. 10 is a diagram illustrating how to calculate of an output luminance of a green sub-pixel at an edge position in each row of pixels. In each row of pixels, one green sub-pixel at an edge position has one adjacent green sub-pixel which is in the same row as the green sub-pixel and closest to the green sub-pixel at one side thereof. The adjacent green sub-pixel is a common pixel of the green sub-pixel. For example, in the first row of pixels, the green sub-pixel at S3G1 is at an edge position, and the green sub-pixel at S6G1 is its adjacent green sub-pixel. Therefore, the output luminance of the green sub-pixel at S3G1 is: C (S3G1)=$K_{G11}$×L (S3G1)+$K_{G21}$×L (S6G1), wherein L (S3G1) is a self luminance value of the green sub-pixel at S3G1, L (S6G1) is a self luminance value of the green sub-pixel at S6G1, $K_{G11}$ is a proportional value corresponding to the self luminance value of the green sub-pixel at S3G1, $K_{G21}$ is a proportional value corresponding to the self luminance value of the green sub-pixel at S6G1. The $K_{G11}$ and $K_{G21}$ may adopt four groups of proportional values, that is, group (1) of proportional values to group (4) of proportional values. For example, group (1) of proportional values may be as follows: wherein, $K_{G11}$ is 0.7, and $K_{G21}$ is 0.3; group (2) of proportional values may be as follows: wherein, $K_{G11}$ is 0.6, and $K_{G21}$ is 0.4; group (3) of proportional values may be as follows: wherein, $K_{G11}$ is 0.8, and $K_{G21}$ is 0.2; and group (4) of proportional values may be as follows: wherein, $K_{G11}$ is 0.9, and $K_{G21}$ is 0.1. In practical application, any one of these groups of proportional values may be selected to calculate the output luminance of sub-pixels, of course, other proper proportional values are applicable as long as a sum of proportional values for each color in each group is one. In the embodiment, group (1) of proportional values are preferably adopted, and in above equation of C (S3G1) for the output luminance of the green sub-pixel, if $K_{G11}$ is 0.7, and $K_{G21}$ is 0.3, then C (S3G1) =0.7×L (S3G1)++0.3×L (S6G1). Calculations of other green sub-pixels at edge positions may refer to above calculation of the green sub-pixel at S3G1, as shown in FIG. 10, the other green sub-pixels at edge positions may include: the green sub-pixel at S1G2, the green sub-pixel at S3G3, the green sub-pixel at S1G4, the green sub-pixel at S3G5, and the green sub-pixel at S1G6.

In the embodiment, the output luminance of all the sub-pixels in the display substrate is calculated by using above calculating method for sub-pixel.

In the display substrate in the invention, one first pixel unit includes a first sub-pixel and a second sub-pixel, and one second pixel unit includes the second sub-pixel and a third sub-pixel, that is, in the invention, three sub-pixels form two pixel units, thus the number of the pixel units needed to form a certain number of pixel units is decreased, and the manufacturing process is simplified and the defective rate of product is decreased. In the embodiment, the output luminance of each sub-pixel equals to the sum of the luminance value of the sub-pixel and the luminance value of its adjacent common sub-pixel(s), and then the display is performed based on the output luminance of the sub-pixel, increasing the visual resolution of the display device.

The second embodiment of the invention provides a display substrate, which differs from that in the first embodiment in that: when the output luminance of a sub-pixel is calculated, a sub-pixel at a non-edge position has four adjacent sub-pixels with the same color, and a sub-pixel at an edge position has one adjacent sub-pixel with the same color.

Figures 11, 12:
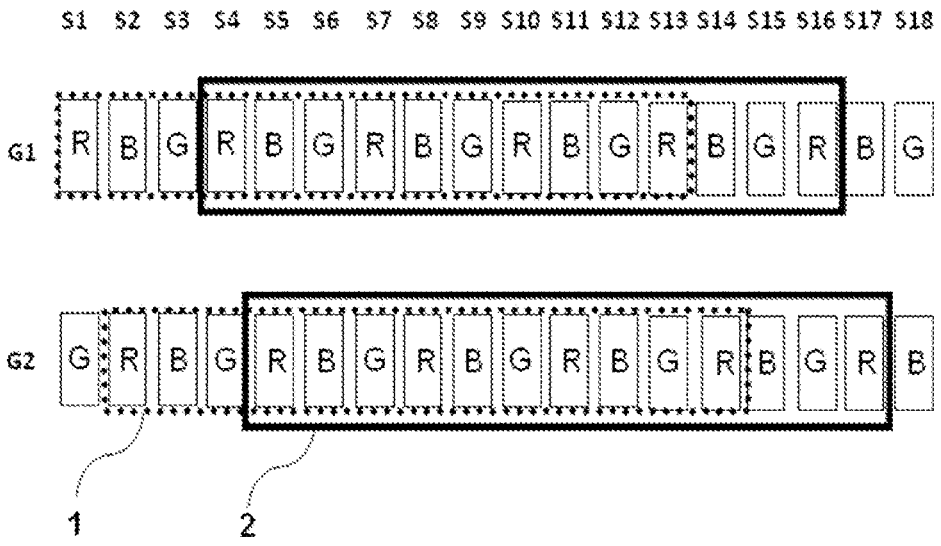
FIG. 11 is a diagram illustrating how to calculate an output luminance of a red sub-pixel according to the second embodiment.
FIG. 12 is diagram of proportional values corresponding to the self luminance values of sub-pixels according to the second embodiment.

FIG. 11 is a diagram illustrating how to calculate an output luminance of a red sub-pixel according to the second embodiment. As shown in FIG. 11, two rows of pixels in one cycle are exemplified, and FIG. 11 is a diagram illustrating calculation of an output luminance of a red sub-pixel at a non-edge position in each row of pixels. In each row of pixels, one red sub-pixel at a non-edge position has four adjacent red sub-pixels, that is, four red sub-pixels which are in the same row as the red sub-pixel and are closest to the red sub-pixel at two sides thereof respectively. These four adjacent red sub-pixels are common pixels of the red sub-pixel. In order to show the relationship between the red sub-pixel and its adjacent red sub-pixels, a plurality of regions are shown by blocks in FIG. 11, for example, in the second row of pixels, region 1 includes 13 sub-pixels, wherein the red sub-pixel at S8G2 is at the center of the region 1, the red sub-pixel at S2G2, the red sub-pixel at S5G2, the red sub-pixel at S11G2 and the red sub-pixel at S14G2 are adjacent red sub-pixels thereof. Therefore, the output luminance of the red sub-pixel at S8G2 is: C (S8G2) =$K_{R1}$×L (S2G2)+$K_{R2}$×L (S5G2)+$K_{R3}$×L (S8G2)+$K_{R4}$×L (S11G2)+$K_{R5}$×(S14G2), wherein L (S2G2) is a self luminance value of the red sub-pixel at S2G2, L (S5G2) is a self luminance value of the red sub-pixel at S5G2. L (S8G2) is a self luminance value of the red sub-pixel at S8G2, L (S11G2) is a self luminance value of the red sub-pixel at S11G2, L (S14G2) is a self luminance value of the red sub-pixel at S14G2, $K_{R1}$ is a proportional value corresponding to the self luminance value of the red sub-pixel at S2G2, $K_{R2}$ is a proportional value corresponding to the self luminance value of the red sub-pixel at S5G2, $K_{R3}$ is a proportional value corresponding to the self luminance value of the red sub-pixel at S8G2, $K_{R4}$ is a proportional value corresponding to the self luminance value of the red sub-pixel at S11G2, and $K_{R5}$ is a proportional value corresponding to the self luminance value of the red sub-pixel at S14G2. FIG. 12 is a diagram of proportional values corresponding to the self luminance values of sub-pixels according to the second embodiment. As shown in FIG. 12, 8 groups of proportional values are listed, that is, group (1) of proportional values to group (8) of proportional values, each group of proportional values comprise: a proportional value corresponding to one red sub-pixel $K_{R2}$, a proportional value corresponding to a first adjacent red sub-pixel $K_{R1}$, a proportional value corresponding to a second adjacent red sub-pixel $K_{R2}$, a proportional value corresponding to a third adjacent red sub-pixel $K_{R4}$, and a proportional value corresponding to a fourth adjacent red sub-pixel $K_{R5}$, a proportional value corresponding to one green sub-pixel $K_{G3}$, a proportional value corresponding to a first adjacent green sub-pixel $K_{G1}$, a proportional value corresponding to a second adjacent green sub-pixel $K_{G2}$, a proportional value corresponding to a third adjacent green sub-pixel $K_{G4}$, and a proportional value corresponding to a fourth adjacent green sub-pixel $K_{G5}$, a proportional value corresponding to one blue sub-pixel $K_{B3}$, a proportional value corresponding to a first adjacent blue sub-pixel $K_{B1}$, a proportional value corresponding to a second adjacent blue sub-pixel $K_{B2}$, a proportional value corresponding to a third adjacent blue sub-pixel $K_{B4}$, and a proportional value corresponding to a fourth adjacent blue sub-pixel $K_{B5}$. In practical application, any one of these groups of proportional values may be selected to calculate the output luminance of sub-pixels, of course, other proper proportional values are applicable as long as a sum of proportional values for each color in each group is one, in the embodiment, group (2) of proportional values are preferably adopted, and in above equation of C (S8G2) for the output luminance of the red sub-pixel, if $K_{R1}$ is 0.05. $K_{R2}$ is 0.1, $K_{R3}$ is 0.7, $K_{R4}$ is 0.1 and $K_{R5}$ is 0.05, then C (S8G2) =0.05×L (S2G2)+0.1×L (S5G2)+0.7×L (S8G2)+0.1×L (S11G2)+0.05×L (S14G2). After verified by pictures, quality of the pictures displayed by the display substrate will be better if group (2) of proportional values, group (3) of proportional values and group (4) of proportional values are adopted, therefore, group (2) of proportional values, group (3) of proportional values and group (4) of proportional values are preferable. Descriptions with respect to the output luminance of the red sub-pixel in region 2 may refer to that with respect to region 1, and will be omitted.

Figure 13:
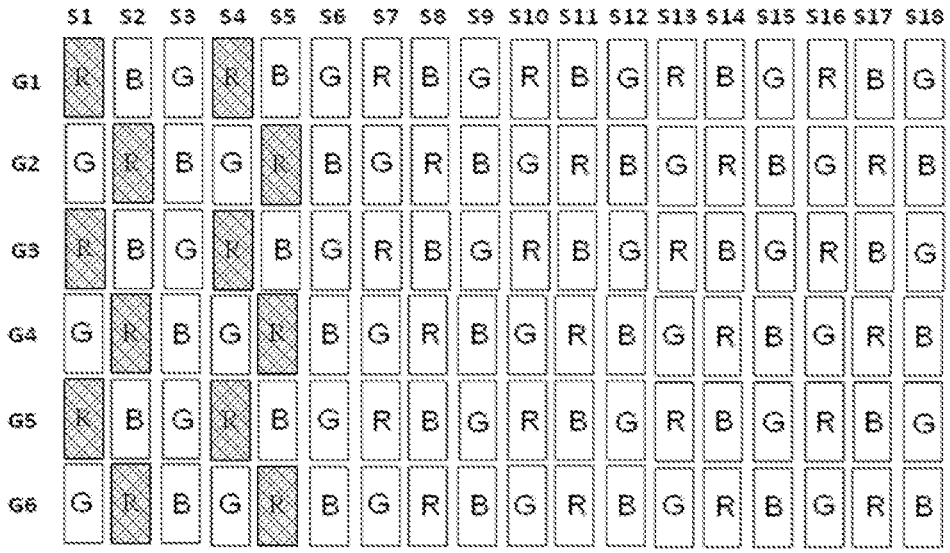
FIG. 13 is an another diagram illustrating how to calculate an output luminance of a red sub-pixel according to the second embodiment.

FIG. 13 is an another diagram illustrating how to calculate an output luminance of a red sub-pixel according to the second embodiment, and FIG. 13 is a diagram illustrating calculation of an output luminance of a red sub-pixel at an edge position in each row of pixels. In each row of pixels, one red sub-pixel at an edge position has one adjacent red sub-pixel which is in the same row as the red sub-pixel and closest to the red sub-pixel at one side thereof. The adjacent red sub-pixel is a common pixel of the red sub-pixel. For example, in the first row of pixels, the red sub-pixel at S1G1 is at an edge position, and the red sub-pixel at S4G1 is its adjacent red sub-pixel. Therefore, the output luminance of the red sub-pixel at S1G1 is: C (S1G1)=$K_{R11}$×L (S1G1)+$K_{R21}$×L (S4G1) wherein L (S1G1) is a self luminance value of the red sub-pixel at S1G1, L (S4G1) is a self luminance value of the red sub-pixel at S4G1, $K_{R11}$ is a proportional value corresponding to the self luminance value of the red sub-pixel at S1G1, $K_{R21}$ is a proportional value corresponding to the self luminance value of the red sub-pixel at S4G1. The red sub-pixel at S4G1 is at an edge position, and the red sub-pixel at S7G1 is its adjacent red sub-pixel. Therefore, the output luminance of the red sub-pixel at S4G1 is: C (S4G1)=$K_{R11}$×L (S4G1)+$K_{R21}$×L (S7G1), wherein L (S4G1) is a self luminance value of the red sub-pixel at S4G1, L (S7G1) is a self luminance value of the red sub-pixel at S7G1, $K_{R11}$ is a proportional value corresponding to the self luminance value of the red sub-pixel at S4G1, $K_{R21}$ is a proportional value corresponding to the self luminance value of the red sub-pixel at S7G1. It can be seen from above, in each row of pixels, the number of the red sub-pixels at edge positions on one side is two. The $K_{R11}$ and $K_{R21}$ may adopt four groups of proportional values, that is, group (1) of proportional values to group (4) of proportional values. For example, group (1) of proportional values may be as follows: wherein, $K_{R11}$ is 0.7, and $K_{R21}$ is 0.3; group (2) of proportional values may be as follows: wherein, $K_{R11}$ is 0.6, and $K_{R21}$ is 0.4; group (3) of proportional values may be as follows: wherein, $K_{R11}$ is 0.8, and $K_{R21}$ is 0.2; and group (4) of proportional values may be as follows: wherein, $K_{R11}$ is 0.9, and $K_{R21}$ is 0.1. In practical application, any one of these groups of proportional values may be selected to calculate the output luminance of sub-pixels, of course, other proper proportional values are applicable as long as a sum of proportional values for one color in each group is one. In the embodiment, group (1) of proportional values are preferably adopted, and in above equation of C (S1G1) for the output luminance of the red sub-pixel, if $K_{R11}$ is 0.7, and $K_{R21}$ is 0.3, then C (S1G1)=0.7×L (S1G1)+0.3×L (S4G1). Calculations of other red sub-pixels at edge positions may refer to above calculation of the red sub-pixel at S1G1, as shown in FIG. 6, the other red sub-pixels at edge positions may include: the red sub-pixel at S2G2, the red sub-pixel at S5G2, the red sub-pixel at S1G3, the red sub-pixel at S4G3, the red sub-pixel at S2G4, the red sub-pixel at S5G4, the red sub-pixel at S1G5, the red sub-pixel at S4G5, and the red sub-pixel at S2G6 and the red sub-pixel at S5G6.

In the embodiment, methods of calculating the output luminance of a blue sub-pixel and the output luminance of a green sub-pixel may refer to the above method of calculating the output luminance of a red sub-pixel, and description thereof will be omitted.

In the embodiment, the output luminance of all the sub-pixels in the display substrate is calculated by using above calculating method for sub-pixel.

In the display substrate in the invention, one first pixel unit includes a first sub-pixel and a second sub-pixel, and one second pixel unit includes the second sub-pixel and a third sub-pixel, that is, in the invention, three sub-pixels form two pixel units, thus the number of the pixel units needed to form a certain number of pixel units is decreased, and the manufacturing process is simplified and the defective rate of product is decreased. In the embodiment, the output luminance of each sub-pixel equals to the sum of the luminance value of the sub-pixel and the luminance value of its adjacent common sub-pixel(s), and then the display is performed based on the output luminance of the sub-pixel, increasing the visual resolution of the display device. Compared with the first embodiment, more adjacent sub-pixels with the same color are used to calculate the output luminance, thus the visual resolution of the display device is further increased.

The third embodiment of the invention provides a display substrate, which differs from that in the first embodiment in that: when the output luminance of a sub-pixel is calculated, adjacent sub-pixel(s) with the same color as the sub-pixel in the column where the sub-pixel is located is used as common pixel(s)

Figure 14:
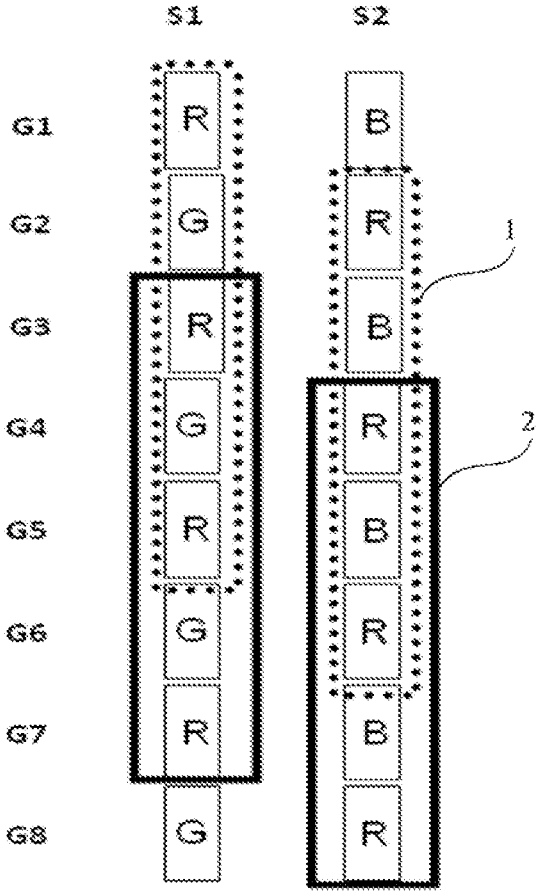
FIG. 14 is a diagram illustrating how to calculate an output luminance of a red sub-pixel according to the third embodiment.

FIG. 14 is a diagram illustrating how to calculate an output luminance of a red sub-pixel according to the third embodiment. As shown in FIG. 14, FIG. 14 is a diagram illustrating calculation of an output luminance of a red sub-pixel at a non-edge position in each column of pixels. In each column of pixels, one red sub-pixel at a non-edge position has two adjacent red sub-pixels, that is, two red sub-pixels which are in the same column as the red sub-pixel and are closest to the red sub-pixel at two sides thereof respectively. These two adjacent red sub-pixels are common pixels of the red sub-pixel. In order to show the relationship between the red sub-pixel and its adjacent red sub-pixels, a plurality of regions are shown by blocks in FIG. 14, for example, in the second column of pixels, region 1 includes 5 sub-pixels, wherein the red sub-pixel at S2G4 is at the center of the region 1, the red sub-pixel at S2G2 and the red sub-pixel at S2G6 are adjacent red sub-pixels thereof, and these two adjacent red sub-pixels are at edge positions of the region 1. Therefore, the output luminance of the red sub-pixel at S2G4 is: C(S2G4)=$K_{R1}$×L (S2G2)+$K_{R2}$×(S2G4)+$K_{R3}$×L (S2G6), wherein L (S2G2) is a self luminance value of the red sub-pixel at S2G2, L (S2G4) is a self luminance value of the red sub-pixel at S2G4, L (S2G6) is a self luminance value of the red sub-pixel at S2G6. $K_{R1}$ is a proportional value corresponding to the self luminance value of the red sub-pixel at S2G2, $K_{R2}$ is a proportional value corresponding to the self luminance value of the red sub-pixel at S2G4, and $K_{R3}$ a proportional value corresponding to the self luminance value of the red sub-pixel at S2G6. FIG. 15 is diagram of proportional values corresponding to the self luminance values of sub-pixels according to the third embodiment. As shown in FIG. 15, 4 groups of proportional values are listed, that is, group (1) of proportional values to group (4) of proportional values, each group of proportional values comprise: a proportional value corresponding to one red sub-pixel $K_{R2}$, a proportional value corresponding to one adjacent red sub-pixel $K_{R1}$, a proportional value corresponding to the other adjacent red sub-pixel $K_{R3}$, a proportional value corresponding to one green sub-pixel $K_{G2}$, a proportional value corresponding to one adjacent green sub-pixel $K_{G1}$, a proportional value corresponding to the other adjacent green sub-pixel $K_{G3}$, a proportional value corresponding to one blue sub-pixel $K_{B2}$, a proportional value corresponding to one adjacent blue sub-pixel $K_{B1}$, and a proportional value corresponding to the other adjacent blue sub-pixel $K_{B3}$. In practical application, any one of these groups of proportional values may be selected to calculate the output luminance of sub-pixels, of course, other proper proportional values are applicable as long as a sum of proportional values for each color in each group is one. In the embodiment, group (1) of proportional values are preferably adopted, and in above equation of C (S2G4) for the output luminance of the red sub-pixel, if $K_{R1}$ is 0.1, $K_{R2}$ is 0.8, and $K_{R3}$ is 0.1, then C (S2G4)=0.1×L (S2G2)+0.8×L (S2G4)+0.1×L (S2G6). After verified by pictures, quality of the pictures displayed by the display substrate will be better if group (1) of proportional values, group (2) of proportional values, group (3) of proportional values and group (4) of proportional values are adopted, therefore, group (1) of proportional values, group (2) of proportional values, group (3) of proportional values and group (4) of proportional values are preferable. Descriptions with respect to the output luminance of the red sub-pixel in region 2 may refer to that with respect to region 1, and will be omitted.

FIG. 16 is an another diagram illustrating how to calculate an output luminance of a red sub-pixel according to the third embodiment, and FIG. 16 is a diagram illustrating calculation of an output luminance of a red sub-pixel at an edge position in each column of pixels. In each column of pixels, one red sub-pixel at an edge position has one adjacent red sub-pixel which is in the same column as the red sub-pixel and closest to the red sub-pixel at one side thereof. The adjacent red sub-pixel is a common pixel of the red sub-pixel. For example, in the first column of pixels, the red sub-pixel at S1G1 is at an edge position, and the red sub-pixel at S1G3 is its adjacent red sub-pixel. Therefore, the output luminance of the red sub-pixel at S1G1 is: C (S1G1)=$K_{R11}$×L (S1G1)+$K_{R21}$×L (S1G3), wherein L (S1G1) is a self luminance value of the red sub-pixel at S1G1, L (S1G3) is a self luminance value of the red sub-pixel at S1G3, $K_{R11}$ is a proportional value corresponding to the self luminance value of the red sub-pixel at S1G1, $K_{R21}$ is a proportional value corresponding to the self luminance value of the red sub-pixel at S1G3. The $K_{R11}$ and $K_{R21}$ may adopt four groups of proportional values, that is group (1) of proportional values to group (4) of proportional values. For example, group (1) of proportional values may be as follows: wherein, $K_{R11}$ is 0.7, and $K_{R21}$ is 0.3; group (2) of proportional values may be as follows: wherein, $K_{R11}$ is 0.6, and $K_{R21}$ is 0.4; group (3) of proportional values may be as follows: wherein. $K_{R11}$ is 0.8, and $K_{R1}$ is 0.2; and group (4) of proportional values may be as follows: wherein, $K_{R11}$ is 0.9, and $K_{R21}$ is 0.1. In practical application, any one of these groups of proportional values may be selected to calculate the output luminance of sub-pixels, of course, other proper proportional values are applicable as long as a sum of proportional values for each other in each group is one. In the embodiment, group (1) of proportional values are preferably adopted, and in above equation of C (S1G1) for the output luminance of the red sub-pixel, if $K_{R11}$ is 0.7, and $K_{R21}$ is 0.3, then C (S1G1)=0.7×L (S1G1)+0.3×L (S1G3). Calculations of other red sub-pixels at edge positions may refer to above calculation of the red sub-pixel at S1G1, as shown in FIG. 6, the other red sub-pixels at edge positions may include: the red sub-pixel at S4G1, the red sub-pixel at S7G1, the red sub-pixel at S10G1, the red sub-pixel at S13G1, and the red sub-pixel at S16G1.

In the embodiment, methods of calculating the output luminance of a blue sub-pixel and the output luminance of a green sub-pixel may refer to the above method of calculating the output luminance of a red sub-pixel, and description thereof will be omitted.

In the embodiment, the output luminance of all the sub-pixels in the display substrate is calculated by using above calculating method for sub-pixel.

In the display substrate in the invention, one first pixel unit includes a first sub-pixel and a second sub-pixel, and one second pixel unit includes the second sub-pixel and a third sub-pixel, that is, in the invention, three sub-pixels form two pixel units, thus the number of the pixel units needed to form a certain number of pixel units is decreased, and the manufacturing process is simplified and the defective rate of product is decreased. In the embodiment, the output luminance of each sub-pixel equals to the sum of the luminance value of the sub-pixel and the luminance value of its adjacent common sub-pixel(s), and then the display is performed based on the output luminance of the sub-pixel, increasing the visual resolution of the display device.

The fourth embodiment of the invention provides a display device comprising a display substrate. Specifically, the display substrate adopts the display substrate in the first embodiment, the second embodiment or the third embodiment, and its description will be omitted.

Optionally, in the embodiment, the display device may be an organic light-emitting display device, and the display substrate may be an organic light-emitting diode (OLED) display substrate.

Optionally, in the embodiment, the display device may be a liquid crystal display device, the display substrate may be an array substrate, the display device may further comprise a color filter substrate, the array substrate and the color filter substrate are arranged opposite to each other, and a liquid crystal layer is filled between the array substrate and the color filter substrate.

Optionally, in the embodiment, the display device may be a computer, a TV, a mobile phone and other apparatus for displaying.

In the display device in the invention, one first pixel unit includes a first sub-pixel and a second sub-pixel, one second pixel unit includes the second sub-pixel and a third sub-pixel, that is, in the invention, three sub-pixels form two pixel units, thus the number of the pixel units needed to form a certain number of pixel units is decreased, and the manufacturing process is simplified and the defective rate of product is decreased. In the embodiment, the output luminance of each sub-pixel equals to the sum of the luminance value of the sub-pixel and the luminance value of its adjacent common sub-pixel(s), and then the display is performed based on the output luminance of the sub-pixel, increasing the visual resolution of the display device.

The fifth embodiment of the invention provides a driving method of the display substrate, wherein the display substrate comprises a plurality of rows of pixel units or a plurality of columns of pixel units, wherein each row of pixel units or each column of pixel units include first pixel units and second pixel units which are arranged alternately, one first pixel unit and one second pixel unit are composed of three sub-pixels, and wherein the first pixel unit includes a first sub-pixel and a second sub-pixel, the second pixel unit includes the second sub-pixel and a third sub-pixel, and the first sub-pixel, the second sub-pixel and the third sub-pixel are arranged in turn. FIG. 17 is a flowchart of a driving method of the display substrate according to the fifth embodiment. As shown in FIG. 17, the driving method comprises:

step 101, obtaining an output luminance of the first sub-pixel, an output luminance of the second sub-pixel, and an output luminance of the third sub-pixel; and step 102, outputting the output luminance of the first sub-pixel, the output luminance of the second sub-pixel, and the output luminance of the third sub-pixel.

Specifically, the step 101 may comprise:

step 1011, adding the luminance value of the first sub-pixel to a luminance value of at least one first common pixel to generate the output luminance of the first sub-pixel, wherein the luminance value of the first sub-pixel is a product of a self luminance value of the first sub-pixel and a corresponding proportional value, the luminance, value of the at least one first common pixel is a product of a self luminance value of the at least one first common pixel and a corresponding proportional value, and the at least one first common pixel is adjacent to the first sub-pixel and has the same color as the first sub-pixel, step 1012, adding the luminance value of the second sub-pixel to a luminance value of at least one second common pixel to generate the output luminance of the second sub-pixel, wherein the luminance value of the second sub-pixel is a product of a self luminance value of the second sub-pixel and a corresponding proportional value, the luminance value of the at least one second common pixel is a product of a self luminance value of the at least one second common pixel and a corresponding proportional value, and the at least one second common pixel is adjacent to the second sub-pixel and has the same color as the second sub-pixel.

step 1013, adding the luminance value of the third sub-pixel to a luminance value of at least one third common pixel to generate the output luminance of the third sub-pixel, wherein the luminance value of the third sub-pixel is a product of a self luminance value of the third sub-pixel and a corresponding proportional value, the luminance value of the at least one third common pixel is a product of a self luminance value of the at least one third common pixel and a corresponding proportional value, and the at least one third common pixel is adjacent to the third sub-pixel and has the same color as the third sub-pixel.

In the embodiment, when the first sub-pixel is at a non-edge position, the number of the at least one first common pixel is more than one, when the second sub-pixel is at a non-edge position, the number of the at least one second common pixel is more than one, and when the third sub-pixel is at a non-edge position, the number of the at least one third common pixel is more than one.

In the embodiment, when the first sub-pixel is at an edge position, the number of the at least one first common pixel is one, when the second sub-pixel is at an edge position, the number of the at least one second common pixel is one, and when the third sub-pixel is at an edge position, the number of the at least one third common pixel is one.

In the embodiment, the at least one first common pixel is located in a row or a column where the first sub-pixel is located, the at least one second common pixel is located in a row or a column where the second sub-pixel is located, and the at least one third common pixel is located in a row or a column where the third sub-pixel is located.

In the embodiment, a sum of the proportional value corresponding to the self luminance value of the first sub-pixel and the proportional value corresponding to the self luminance value of the at least one first common pixel is one a sum of the proportional value corresponding to the self luminance value of the second sub-pixel and the proportional value corresponding to the self luminance value of the at least one second common pixel is one; and a sum of the proportional value corresponding to the self luminance value of the third sub-pixel and the proportional value corresponding to the self luminance value of the at least one third common pixel is one.

In practical application, step 1011 step 1012 and step 1013 may be performed in other orders.

Method for calculating the output luminance of the first sub-pixel, the second sub-pixel, and the third pixel obtained in step 101 is the same as that in the first embodiment, the second embodiment or the third embodiment in principle, thus description thereof will be omitted In the driving method of the display substrate in the embodiment, the output luminance of each sub-pixel is obtained, the output luminance of the sub-pixel equals to the sum of the luminance value of the sub-pixel and the luminance value of its adjacent common sub-pixel(s), and the output luminance of the sub-pixel is output. As three sub-pixels may form two pixels, so the display may be based on the output luminance of each sub-pixel, thus the visual resolution of the display device is increased.

While a manner of the first sub-pixels and the second sub-pixels being repeatedly arranged in rows has been described above, the invention is not limited thereto. The first sub-pixels and the second sub-pixels may be repeatedly arranged in columns, and the sub-pixels arranged in columns may be processed with a similar method to those in the first embodiment, the second embodiment and the third embodiment.

It should be understood that above embodiments are just examples for illustrating the principle of the invention, however, the invention is not limited thereto. Various modifications and variations can be made by a person skilled in the art without departing from the spirit and the scope of the present invention. These modifications and variations should be considered to be within protection scope of the present invention.

The invention claimed is:

1. A display substrate of a display device, the display substrate comprising a plurality of rows of pixel units or a plurality of columns of pixel units, wherein each row of pixel units or each column of pixel units include first pixel units and second pixel units which are arranged alternately, one first pixel unit and one second pixel unit are composed of three sub-pixels, and wherein the first pixel unit includes a first sub-pixel and a second sub-pixel, the second pixel unit includes the second sub-pixel and a third sub-pixel, and the first sub-pixel, the second sub-pixel and the third sub-pixel are arranged in turn, wherein obtaining an output luminance of the first sub-pixel, an output luminance of the second sub-pixel, and an output luminance of the third sub-pixel comprises:

adding a luminance value of the first sub-pixel to a luminance value of at least one first common pixel to generate the output luminance of the first sub-pixel, wherein the luminance value of the first sub-pixel is a product of a self luminance value of the first sub-pixel and a corresponding proportional value, the luminance value of the at least one first common pixel is a product of a self luminance value of the at least one first common pixel and a corresponding proportional value, and the at least one first common pixel is adjacent to the first sub-pixel and has the same color as the first sub-pixel;

adding a luminance value of the second sub-pixel to a luminance value of at least one second common pixel to generate the output luminance of the second sub-pixel, wherein the luminance value of the second sub-pixel is a product of a self luminance value of the second sub-pixel and a corresponding proportional value, the luminance value of the at least one second common pixel is a product of a self luminance value of the at least one second common pixel and a corresponding proportional value, and the at least one second common pixel is adjacent to the second sub-pixel and has the same color as the second sub-pixel; and adding a luminance value of the third sub-pixel to a luminance value of at least one third common pixel to generate the output luminance of the third sub-pixel, wherein the luminance value of the third sub-pixel is a product of a self luminance value of the third sub-pixel and a corresponding proportional value, the luminance value of the at least one third common pixel is a product of a self luminance value of the at least one third common pixel and a corresponding proportional value, and the at least one third common pixel is adjacent to the third sub-pixel and has the same color as the third sub-pixel.

2. The display substrate of claim 1, wherein when the second sub-pixel includes a red sub-pixel, the first sub-pixel includes a green sub-pixel and the third sub-pixel includes a blue sub-pixel, or the first sub-pixel includes a blue sub-pixel and the third sub-pixel includes a green sub-pixel; or when the second sub-pixel includes a green sub-pixel, the first sub-pixel includes a red sub-pixel and the third sub-pixel includes a blue sub-pixel, or the first sub-pixel includes a blue sub-pixel and the third sub-pixel includes a red sub-pixel; or when the second sub-pixel includes a blue sub-pixel, the first sub-pixel includes a red sub-pixel and the third sub-pixel includes a green sub-pixel, or the first sub-pixel includes a green sub-pixel and the third sub-pixel includes a red sub-pixel.

3. The display substrate of claim 2, wherein the first sub-pixels, the second sub-pixels, and the third sub-pixels are arranged repeatedly in turn on a basis of a 2×3 matrix constructed by two adjacent pixel rows.

4. The display substrate of claim 1, wherein the first sub-pixels, the second sub-pixels, and the third sub-pixels are arranged repeatedly in turn on a basis of a 2×3 matrix constructed by two adjacent pixel rows.

5. A driving method of a display substrate of a display device, wherein the display substrate comprises a plurality of rows of pixel units or a plurality of columns of pixel units, wherein each row of pixel units or each column of pixel units include first pixel units and second pixel units which are arranged alternately, one first pixel unit and one second pixel unit are composed of three sub-pixels, and wherein the first pixel unit includes a first sub-pixel and a second sub-pixel, the second pixel unit includes the second sub-pixel and a third sub-pixel, and the first sub-pixel, the second sub-pixel and the third sub-pixel are arranged in turn, wherein the driving method comprises:

obtaining an output luminance of the first sub-pixel, an output luminance of the second sub-pixel, and an output luminance of the third sub-pixel; and outputting the output luminance of the first sub-pixel, the output luminance of the second sub-pixel, and the output luminance of the third sub-pixel;

wherein obtaining an output luminance of the first sub-pixel, an output luminance of the second sub-pixel, and an output luminance of the third sub-pixel comprises:

adding a luminance value of the first sub-pixel to a luminance value of at least one first common pixel to generate the output luminance of the first sub-pixel, wherein the luminance value of the first sub-pixel is a product of a self luminance value of the first sub-pixel and a corresponding proportional value, the luminance value of the at least one first common pixel is a product of a self luminance value of the at least one first common pixel and a corresponding proportional value, and the at least one first common pixel is adjacent to the first sub-pixel and has the same color as the first sub-pixel;

adding a luminance value of the second sub-pixel to a luminance value of at least one second common pixel to generate the output luminance of the second sub-pixel, wherein the luminance value of the second sub-pixel is a product of a self luminance value of the second sub-pixel and a corresponding proportional value, the luminance value of the at least one second common pixel is a product of a self luminance value of the at least one second common pixel and a corresponding proportional value, and the at least one second common pixel is adjacent to the second sub-pixel and has the same color as the second sub-pixel; and adding a luminance value of the third sub-pixel to a luminance value of at least one third common pixel to generate the output luminance of the third sub-pixel, wherein the luminance value of the third sub-pixel is a product of a self luminance value of the third sub-pixel and a corresponding proportional value, the luminance value of the at least one third common pixel is a product of a self luminance value of the at least one third common pixel and a corresponding proportional value, and the at least one third common pixel is adjacent to the third sub-pixel and has the same color as the third sub-pixel.

6. The driving method of claim 5, wherein when the first sub-pixel is at a non-edge position, the number of the at least one first common pixel is more than one; when the second sub-pixel is at a non-edge position, the number of the at least one second common pixel is more than one; and when the third sub-pixel is at a non-edge position, the number of the at least one third common pixel is more than one.

7. The driving method of claim 5, wherein when the first sub-pixel is at an edge position, the number of the at least one first common pixel is one; when the second sub-pixel is at an edge position, the number of the at least one second common pixel is one; and when the third sub-pixel is at an edge position, the number of the at least one third common pixel is one.

8. The driving method of claim 5, wherein the at least one first common pixel is located in a row or a column where the first sub-pixel is located, the at least one second common pixel is located in a row or a column where the second sub-pixel is located, and the at least one third common pixel is located in a row or a column where the third sub-pixel is located.

9. The driving method of claim 5, wherein a sum of the proportional value corresponding to the self luminance value of the first sub-pixel and the proportional value corresponding to the self luminance value of the at least one first common pixel is one;

a sum of the proportional value corresponding to the self luminance value of the second sub-pixel and the proportional value corresponding to the self luminance value of the at least one second common pixel is one; and a sum of the proportional value corresponding to the self luminance value of the third sub-pixel and the proportional value corresponding to the self luminance value of the at least one third common pixel is one.

* * * * *